US007762162B2

(12) United States Patent
Phillips, Sr. et al.

(10) Patent No.: US 7,762,162 B2
(45) Date of Patent: Jul. 27, 2010

(54) LOCKING PLIERS WITH CAM

(75) Inventors: Charles M. Phillips, Sr., Zelienople, PA (US); Mark P. Noah, Butler, PA (US); Jeffrey B. Hile, Wexford, PA (US)

(73) Assignee: Penn United Technologies, Inc., Cabot, PA (US)

( * ) Notice: Subject to any disclaimer, the term of this patent is extended or adjusted under 35 U.S.C. 154(b) by 77 days.

(21) Appl. No.: 12/116,333

(22) Filed: May 7, 2008

(65) Prior Publication Data

US 2008/0276766 A1 Nov. 13, 2008

Related U.S. Application Data

(60) Provisional application No. 60/916,417, filed on May 7, 2007.

(51) Int. Cl.
*B25B 7/12* (2006.01)

(52) U.S. Cl. ..... 81/367

(58) Field of Classification Search ..... 81/367–384
See application file for complete search history.

(56) References Cited

U.S. PATENT DOCUMENTS 2,627,774 A * 2/1953 Walter ..... 81/368
3,793,914 A * 2/1974 Helms ..... 81/378
6,095,019 A * 8/2000 Warheit et al. ..... 81/370
6,264,388 B1 * 7/2001 Wang ..... 401/109
6,948,351 B2 * 9/2005 Norin ..... 72/409.12

* cited by examiner

*Primary Examiner*—D. S Meislin
(74) *Attorney, Agent, or Firm*—Eckert Seamans Cherin & Mellott, LLC; David C. Jenkins, Esq.

(57) ABSTRACT

A pair of locking pliers having an adjusting device that utilizes a cam assembly. The pliers, preferably, include a trolley disposed in a first handle member that defines a channel. The trolley is structured to be coupled to a link assembly wherein the position of the link assembly relative to the distal end of the first handle member affects the spacing of the pliers' jaws. The cam assembly is, preferably, a planar disk-like body having a radially extending handle and, preferably, a plurality of flats about the circumference. The cam assembly is disposed, preferably, in the plane defined by the first handle member and the second handle assembly. The cam is coupled to the first handle member at the distal end of the handle portion and its' axis extends generally perpendicular to the plane defined by the first handle member and the second handle assembly. At this location, the cam plurality of flats are structured to engage the trolley/cam follower as the cam handle extends beyond the first handle member distal end. Rotation of the cam causes the trolley, and therefore link assembly, to move relative to the distal end of the first handle member.

4 Claims, 8 Drawing Sheets

LOCKING PLIERS WITH CAM

CROSS-REFERENCE TO RELATED APPLICATION

The present application claims the benefit of U.S. Provisional Patent Application Ser. No. 60/916,417, filed May 7, 2007, and entitled "locking Pliers with CAM."

BACKGROUND OF THE INVENTION

1. Field of the Invention

This invention relates to locking pliers and, more specifically to a cam incorporated into the locking assembly of the pliers.

2. Background Information

Traditional pliers have, generally, two elongated members each having a handle at one end and a jaw at the other. The members cross over each other and are coupled at a single, medial pivot in a manner similar to scissors. Locking pliers, as used herein, have at least four primary members: a first member, that is a combined jaw/handle, a second jaw member, a second handle assembly, and one or more linking members. The second jaw member is pivotally coupled to the first member adjacent to the jaw so that the jaw members may close together. The second handle assembly is pivotally coupled to the second jaw member. The linking member extends between the first handle member and the second handle assembly. More specifically, the linking member extends from the distal end of the first handle member to a location adjacent to the pivot coupling of the second jaw and second handle assembly.

Thus, the first member jaw portion and the second jaw may be moved between a first, open position and a second, closed position. The second handle and the linking member also move between respective first positions and second positions corresponding to the position of the jaws. When the components of the locking pliers are in their respective first positions, the pliers are in a first, open configuration. Similarly, when the components of the locking pliers are in their respective second positions, the pliers are in a second, closed configuration. The locking pliers typically have one or more springs structured to bias the locking pliers to the first configuration.

Locking pliers may have improved operational capabilities by reconfiguring the elements or adding additional links to provide for an enhanced closing motion. For example, in one improvement the second handle assembly may be coupled to the first member adjacent to the jaw, and, a second linking member extends from the second handle assembly to the second jaw. With this addition, the line of force acting on the second linking member/second jaw coupling is generally more tangent to the first member/second jaw pivot and, as such, enhances the force applied by the user when compared to the configuration identified above.

It is further noted that, in this configuration, the jaws have a limited range of motion. Thus, if the jaws are far apart in the first position, the jaws may not be able to close completely when the handles are moved into the second position. Alternatively, if the jaws are close together in the first position, the jaws may not be able to extend around a larger object. To overcome this disadvantage locking pliers typically have a longitudinally adjustable coupling between the linking member and the first member. That is, the first handle member portion typically has a U-shaped cross-section that acts as a channel. The distal end of the first handle member portion is closed off with a generally flat flange. A first end of the linking member is slidably disposed in the channel. The location of the linking member first end relative to the first handle member portion is typically made adjustable by having a threaded rod extend through the flange. As the threaded rod, which has an external head/handle, is moved into the first handle member portion, the location of the linking member first end is adjusted toward the first member jaw portion. Generally, the closer the linking member first end is to the first member jaw portion, the closer the jaws are when in the first position.

Further, the geometry of the linking member(s) may be structured so as to act as a toggle when the pliers move into the second, closed position. That is, as the handles are moved together, the linking member will move "over-toggle" and become locked relative to the second handle assembly. If the jaws are engaging an object, the pliers will become locked about that object. With regard to the toggle, the movement of the threaded rod adjusts the location that the linking member moves over toggle and become locked.

Thus, in operation, a user typically begins with the threaded rod extended relatively far, if not as far as possible, from the first handle member portion. In this configuration, the jaws are more separated than when the threaded rod is moved into the first handle member portion. When the user draws the handles together, the jaws close and, if the jaws were initially too far apart, the user can estimate about how far to move the threaded rod for a better, tighter fit or to set the point where the linking member moves over-toggle and locks the pliers to the object. Alternatively, a user may move the pliers into the second position around an object and then use the threaded rod, that is, insert the threaded rod into the first handle member portion, to lock the pliers in place.

The disadvantage to using a threaded rod is that manipulation of the threaded rod is slow and requires dexterity on the part of the user. Generally, the user must grasp and twist the threaded rod with their fingers. Thus, in most instances, the user must hold the pliers with one hand while manipulating the threaded rod with the other hand. This can be particularly disadvantageous when the user is, for example, attempting to grip two or more heavy objects in the jaw and then lock the jaw. In such an instance, the user must be strong and quick or the user is likely to loose their grip.

SUMMARY OF THE INVENTION

The concept disclosed herein provides for a locking pliers adjusting device that utilizes a cam assembly. The pliers, preferably, include a trolley disposed in the first handle member portion channel. The trolley is structured to be coupled to the linking member and to act as a cam follower. The cam assembly is, preferably, a planar disk-like body having a radially extending handle and, preferably, a plurality of flats about the circumference. The cam assembly is disposed, preferably, in the plane defined by the first handle member and the second handle assembly. The cam assembly further has an axis. The axis is coupled to the first member at the distal end of the handle portion and extends generally perpendicular to the plane defined by the first handle member and the second handle assembly. At this location, the cam plurality of flats are structured to engage the trolley/cam follower as the cam handle extends beyond the first handle member distal end.

The cam plurality of flats are structured so that each flat is a different radial distance from the cam axis. Preferably, the radii of the flats increases/decreases in series. Thus, for example, on a cam with four flats, a first flat may be the closest to the axis; the second flat is at a slightly greater radial distance from the axis than the first flat; the third flat is at a slightly greater radial distance from the axis than the second flat; and the fourth flat is at the greatest radial distance from the axis. Between each flat is a rounded transition. In this configuration, the location of the trolley relative to the first handle member portion, and thus the location of the linking member first end relative to the first handle member portion and the spread of the jaws in the first position, is controlled by the cam. That is, when the cam first flat engages the trolley, the trolley is disposed close to the cam axis and the distal end of the first handle member portion. Thus, when the pliers are in the first configuration, the jaws are spaced a first distance apart. Conversely, when the cam fourth flat engages the trolley, the trolley is disposed far from the cam axis and the distal end of the first handle member portion. Thus, when the pliers are in the first configuration, the jaws are spaced a fourth distance apart which is a shorter distance than the first distance. There are intermediate positions for the trolley, with corresponding jaw spacing distances, when the trolley engages the second and third flats.

Because the position of the cam is controlled by the handle, a user may quickly adjust the cam to a desired position. That is, unlike the prior art threaded rod that must be grasped by the users fingers, the cam handle may be moved by a single finger, the back of the hand, and so forth. Such a device for adjusting the trolley is much faster and more efficient than a threaded rod.

While a cam having flats is preferred, it is noted that the cam may also have an outer surface with a gradually increasing radius. That is, when the trolley/cam follower engages a flat on the cam, and in response to the bias created by the locking pliers spring, the cam will be generally maintained in the set position by the bias of the trolley as the trolley engages the flat. Thus, the cam with flats is preferred as the cam is less prone to rotate unintentionally. However, a cam with a generally smooth radial surface provides an, essentially, infinite number of trolley positions between the minimum and maximum radii of the cam. To avoid having this embodiment of the cam slip, the cam may have, for example, a friction fit between the axle and the distal end of the first handle member portion. That is, where the axle is rotatably disposed in a snug opening within the distal end of the first handle member portion, the cam will resist turning freely about the axle.

BRIEF DESCRIPTION OF THE DRAWINGS

A full understanding of the invention can be gained from the following description of the preferred embodiments when read in conjunction with the accompanying drawings in which.

DETAILED DESCRIPTION

As used herein, the "radius" of a flat portion located on the periphery of a generally circular body means the distance from the center of the body to the middle of the flat portion.

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body.

Figure 1:
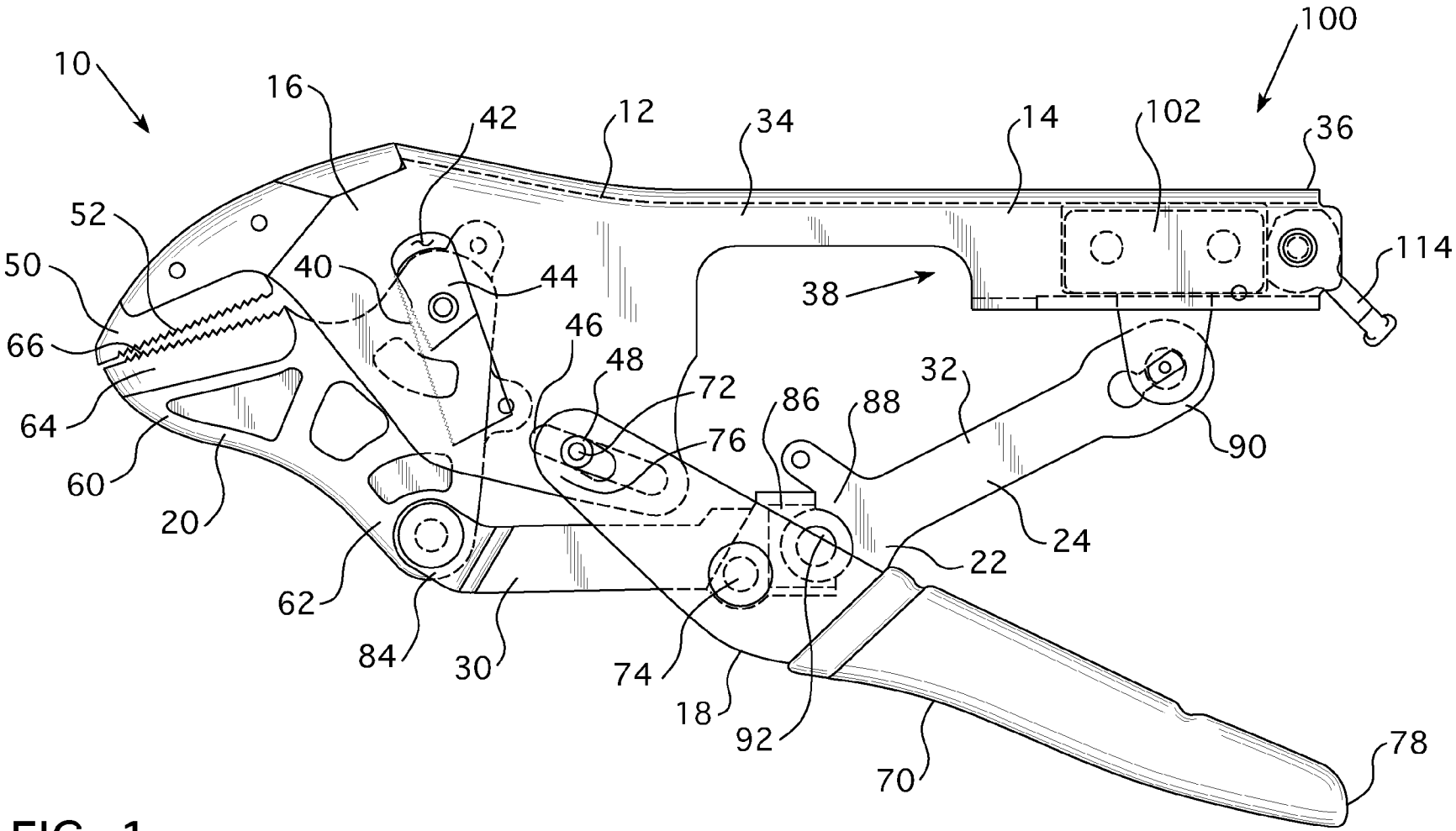
FIG. 1 is a side view of the locking pliers.
Figure 2:
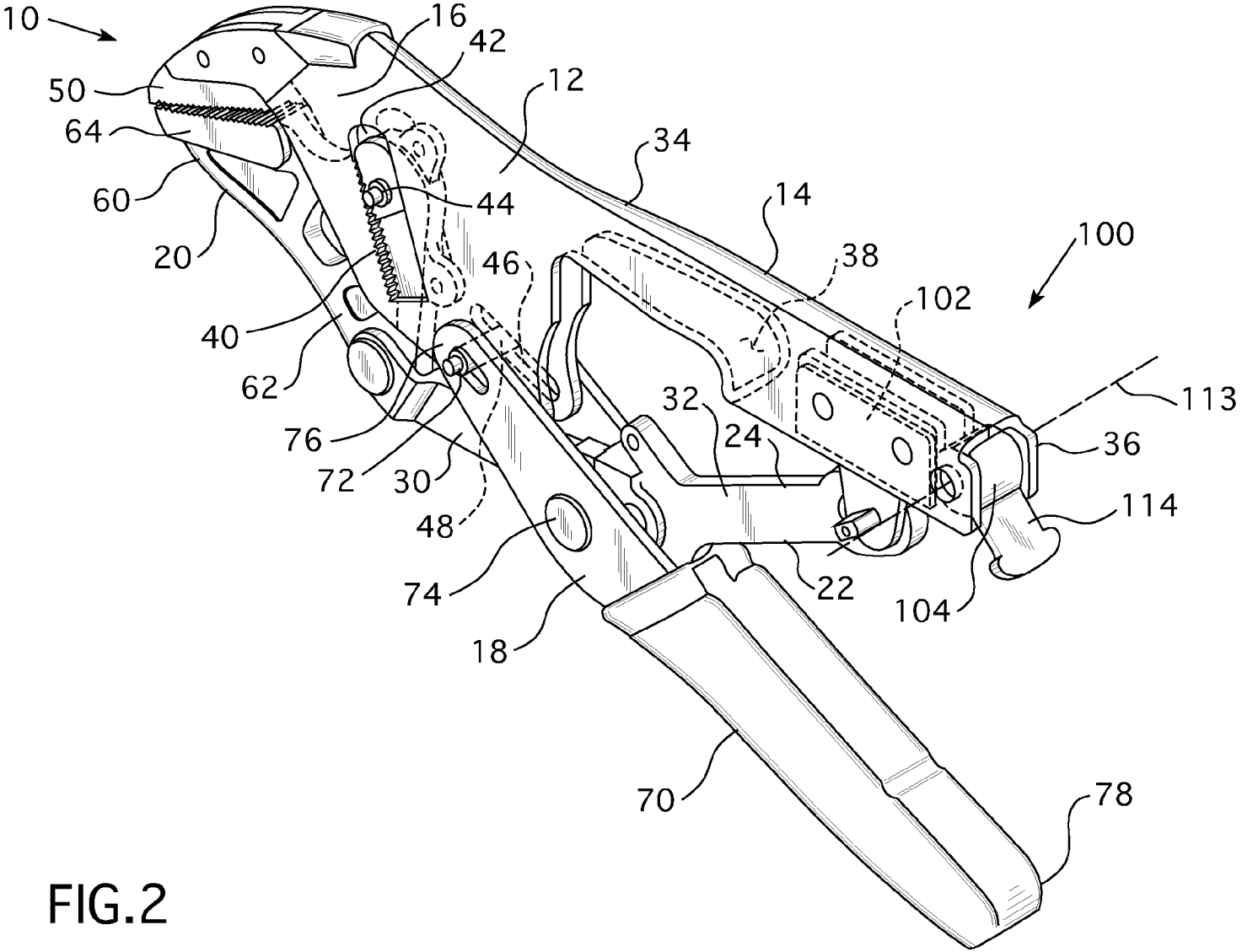
FIG. 2 is an isometric and cutaway view of the locking pliers.
Figure 3:
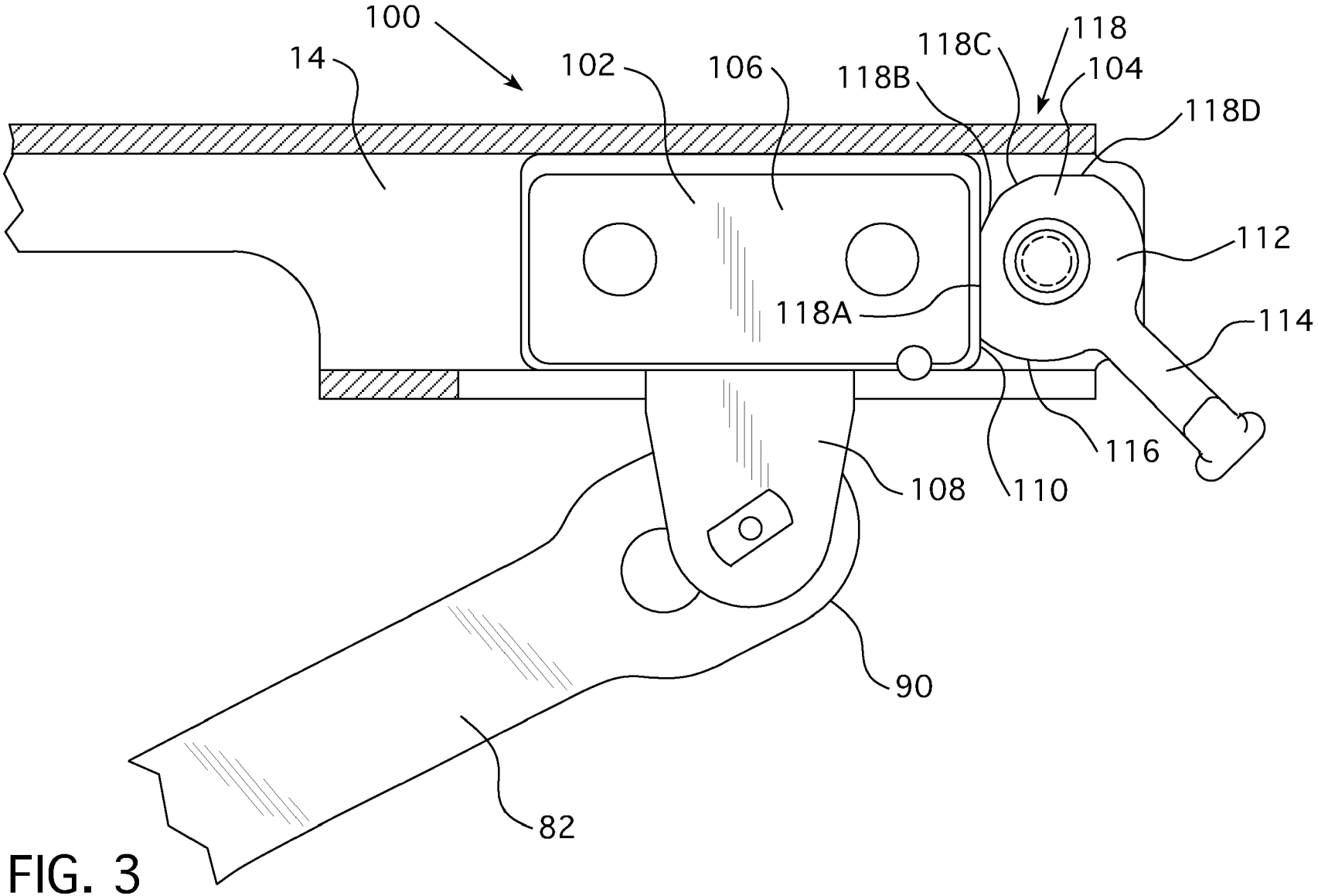
FIG. 3 is a detailed cross-sectional view of the cam in a first position.
Figure 4:
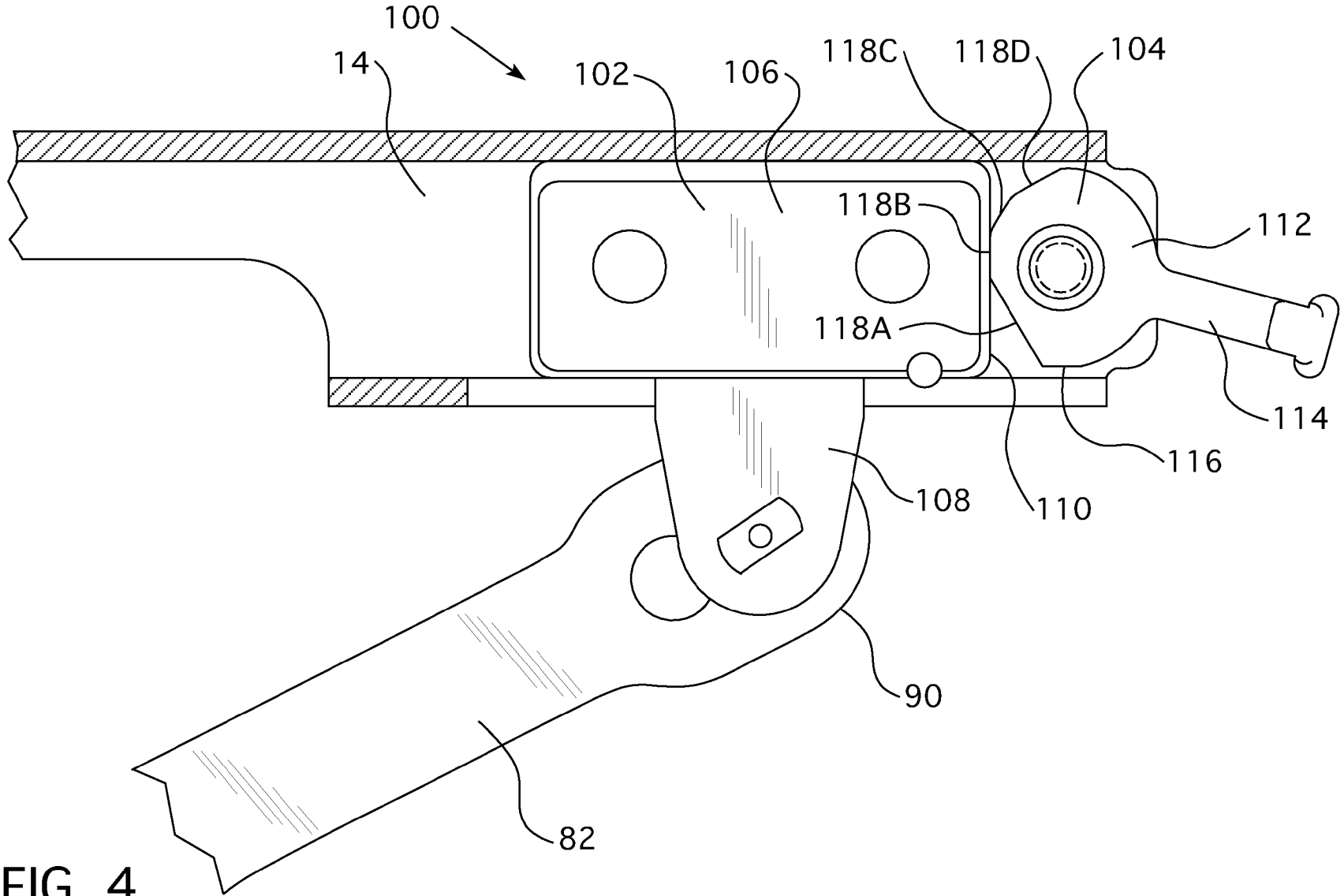
FIG. 4 is a detailed cross-sectional view of the cam in a second position.
Figure 5:
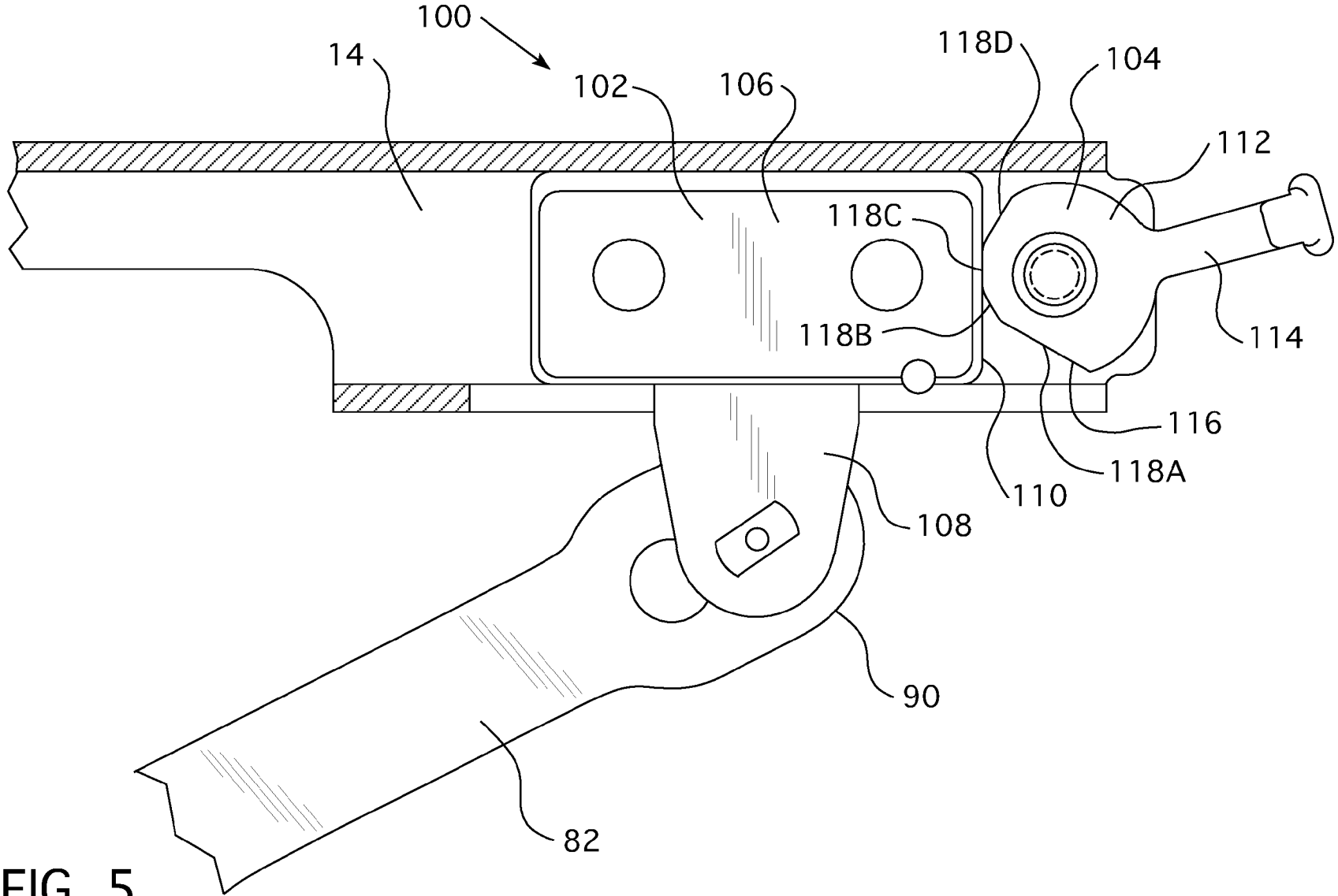
FIG. 5 is a detailed cross-sectional view of the cam in a third position.
Figure 6:
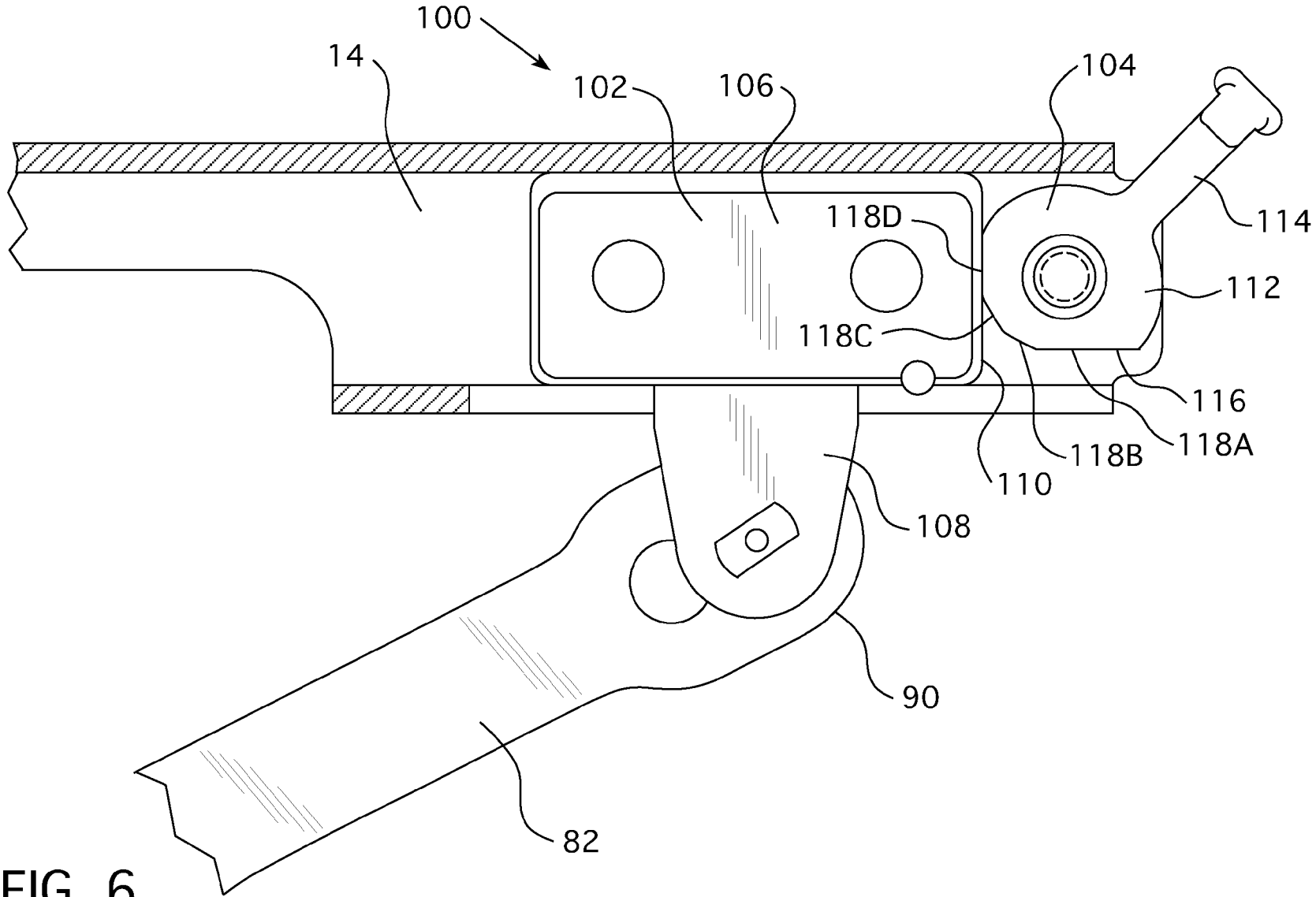
FIG. 6 is a detail cross-sectional view of the cam in a fourth position.
Figure 7:
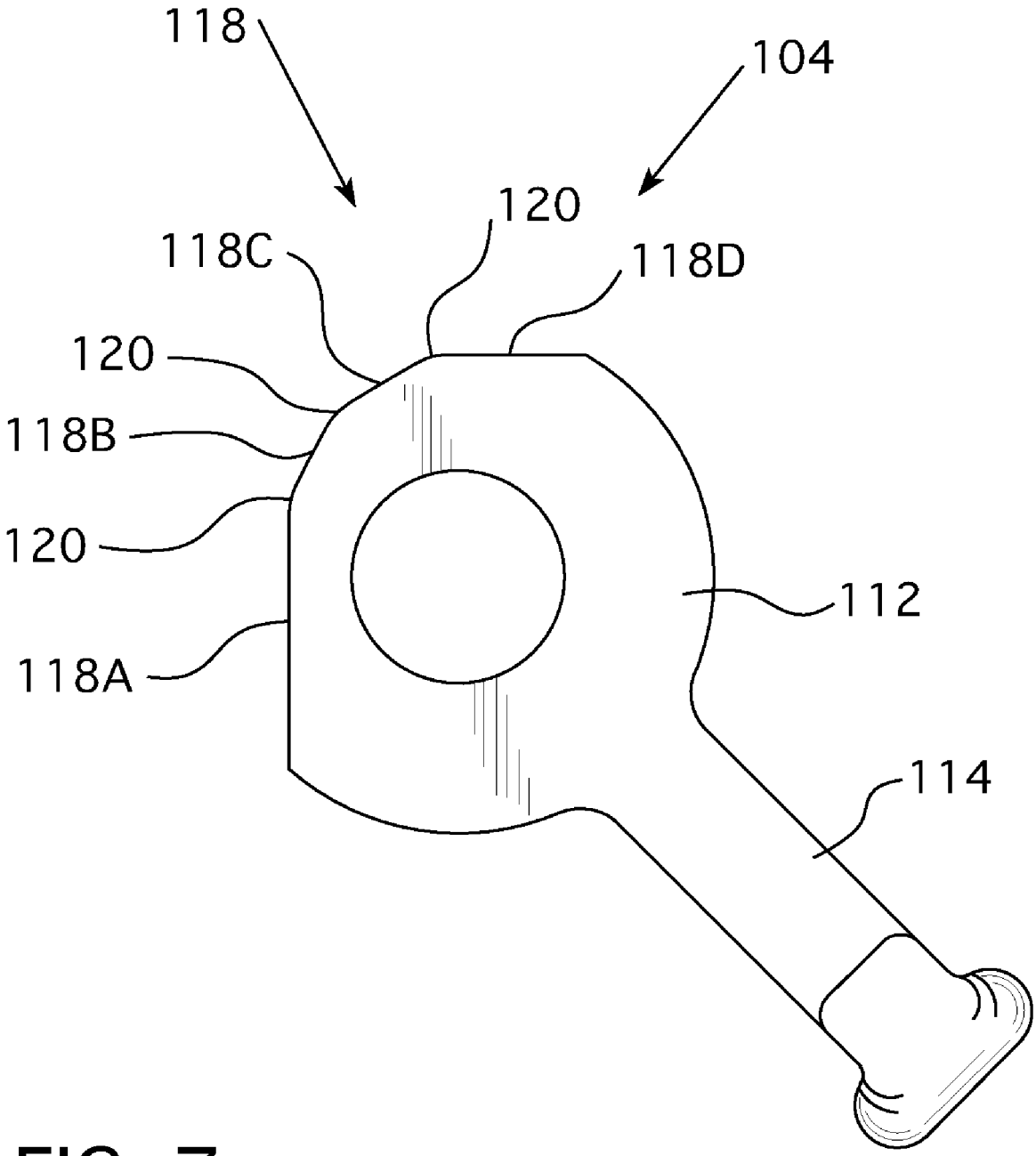
FIG. 7 is a detailed side view of the cam.

As shown in FIGS. 1 and 2, a pair of locking pliers 10 has a first assembly 12, that includes an elongated first handle member 14 and a first jaw member 16, an elongated second handle assembly 18, a second jaw member 20, and a link assembly 22 having at least one link 24. As shown, the link assembly 22 includes an upper link 30 and a lower link 32. As is known in the art, the locking pliers 10 may be made from a plurality of laminations wherein one component may be disposed on both sides of another component. That is, one component may "sandwich" another component. Typically, it does not matter which of the components has the two layers and which component has the single layer. For example, as shown in FIG. 2, the first jaw member 16 has two layers that sandwich the second jaw member 20. However, it is understood that the construction could be reversed with the second jaw member 20 sandwiching the first jaw member 16 (not shown). In view of the reversible nature of which component sandwiches which, the following discussion shall address the locking pliers 10 without reference to a specific construction of layers. That is, as set forth above, a component will simply be named, e.g., the a first jaw member 16, without detailing which components have one layer and which components have two, or more, layers.

The first assembly 12 is generally rigid. That is, the first handle member 14 and a first jaw member 16 are fixed together and, as shown, are preferably formed from a unitary body. The first handle member 14 has a proximal end 34 fixed to the first jaw member 16 and a distal end 36. The first handle member distal end 36 defines a generally longitudinal channel 38. The cam assembly 100, discussed below, is substantially disposed in the first handle member channel 38.

The first jaw member 16 includes a rack 40 disposed in a cutout 42, a pawl 44, a race 46, and a slider 48. The pawl 44 is movably disposed in the cutout 42 and structured to move longitudinally therein and to engage the rack 40. The slider 48 is slidably disposed in the race 46 and structured to move longitudinally therein. Further, the first jaw member 16 has an upper end defining a first jaw element 50. The first jaw element 50 has a generally straight portion with a plurality of gripping teeth 52.

The second jaw member 20 has a body with an upper portion 60 and a lower portion 62. The second jaw member upper portion 60 defines a second jaw element 64 having a generally straight portion with a plurality of gripping teeth 66. The second jaw element 64 is sized and shaped to generally correspond to the size and shape of the first jaw element 50. The second jaw member lower portion 62, preferably, has a greater width than the second jaw member upper portion 60 and thereby provides coupling points for the other components of the locking pliers 10.

The second handle assembly 18 includes an elongated handle member 70, a proximal pivotal coupling 72 and a medial pivotal coupling 74. The second handle assembly handle member 70 has a proximal end 76 and a distal end 78.

The second handle assembly proximal pivotal coupling 72 is disposed at the second handle assembly handle member proximal end 76.

As noted above, the link assembly 22 in the embodiment shown includes an elongated first, upper link 30 and an elongated second lower link 32. Both the first and second links 30, 32 have first, upper ends 84, 88 and second, lower ends 86, 90, respectively. Each of the link ends 84, 86, 88, 90 are structured to be pivotally coupled to another component. The first link 30 further includes a medial pivot coupling 92 disposed between the first link first end 84 and the first link second end 86. As shown, the medial pivot coupling 92 is disposed closer to the first link second end 86. As discussed below, the first link 30 and the second link 32 are pivotally coupled together and are structured to move between a first, open position and a second over-toggle position.

The locking pliers 10 are assembled as follows. The second jaw member 20 is pivotally coupled to the first jaw member 16. More specifically, the pawl 44 is pivotally coupled to the second jaw member lower portion 62. The second handle assembly handle member 70, and more specifically the proximal pivotal coupling 72, is pivotally coupled to the slider 48. The first link first end 84 is pivotally coupled to the second jaw member lower portion 62. The first link medial pivot coupling 92 is pivotally coupled to the second handle assembly medial pivotal coupling 74. The first link second end 86 is pivotally coupled to the second link first end 88. The second link second end 90 is pivotally coupled to the cam assembly 100, discussed below.

In this configuration, the second jaw member 20 is structured to move between a first, open position, wherein the first jaw element 50 and the second jaw element 64 are spaced from each other, and a second position, wherein the first jaw element 50 and the second jaw element 64 are closer to, or in contact with, each other. The jaw elements 50, 64 move in response to a relative motion between the first assembly first handle member 14 and the second handle assembly handle member 70. That is, the first assembly first handle member 14 and the second handle assembly handle member 70 also move between a first, open position, wherein the first assembly first handle member 14 and the second handle assembly handle member 70 are spaced from each other, and a second position, wherein the first assembly first handle member 14 and the second handle assembly handle member 70 are closer to, or in contact with, each other. It is noted that the motion of the second handle assembly handle member 70 is transferred to the second jaw member 20 via the link assembly 22. Further, it is noted that when the jaw elements 50, 64 and the handle members 14, 70 are in the open positions, the link assembly 22 is also in an open position. When the jaw elements 50, 64 and the handle members 14, 70 are in the closed positions, the link assembly 22 is in an over-toggle position, whereby the link assembly 22 acts to lock the locking pliers 10. A spring (not shown) extends between the link assembly 22 and the first assembly first handle member 14 and biases the jaw elements 50, 64 and the handle members 14, 70 to the first, open positions.

The cam assembly 100 is structured to move the location of the coupling between the second link second end 90 relative to the first jaw member 16. Moreover, the proximity of the at least one link to the distal end of the first handle member 14 affects the spacing of the jaw members. That is, the position of the second jaw member 20 relative to the first jaw element 50 in the open position changes as the at least one link moves relative to the first handle distal end. Generally, the closer the coupling between the second link second end 90 is to the first jaw member 16, the closer the first link 30 is to the second jaw member lower portion 62 and the closer the second jaw element 64 is to the first jaw element 50. To provide for this adjustable motion, the cam assembly 100 includes a trolley 102 and a cam 104.

The trolley 102 has a body 106 sized to fit within the first handle member channel 38. The trolley body 106 has a coupling extension 108 and a cam follower 110. Preferably, the cam follower 110 is one side of the trolley body 106. The cam 104 has a disk-like body 112 with an axis of rotation 113 and a radially extending handle 114. Preferably, the radial surface 116 of the cam body 112 includes a plurality of flats 118. Each flat 118 is disposed at a different radial distance from the center of the cam disk-like body 112. Further, it is desirable that the radii of the flats 118 increases/decreases in series. Thus, as shown, there may be four flats 118A, 118B, 118C, and 118D. The first flat 118A is, preferably, the closest to the axis 113, the second flat 118B is at a slightly greater radial distance from the axis 113 than the first flat 118A, the third flat 118C is at a slightly greater radial distance from the axis 113 than the second flat 118B, and the fourth flat 118D is at the greatest radial distance from the axis 113. Preferably, the first flat 118A has a radius of between about 0.18 and 0.22 and more preferably about 0.20 inch. Further, each successive flat 118B, 118C, 118D has a radius that is about 0.02 inches further from the axis 113 than the prior flat 118. Between each flat 118 is a rounded transition 120.

The cam assembly 100 is assembled as follows. The cam 104 is rotatably coupled to the first assembly first handle member distal end 36 and structured to engage said trolley cam follower 110. The cam axis 113 extends generally perpendicularly to the longitudinal axis of the first handle member 14. Further, the cam radial surface 116 is disposed at least partially within the channel 38. The cam handle 114 extends from the first assembly first handle member distal end 36. The trolley 102 is disposed within the first handle member channel 38 and the trolley cam follower 110 is structured to engage the cam radial surface 116. The user may rotate the cam 104 on the axis 113 by moving the cam handle 114. Thus, the trolley 102 is structured to slide between a plurality of positions relative to the cam 104. In the preferred embodiment, where the cam 104 has four flats 118A, 118B, 118C, 118D, the trolley 102 is structured to move between four corresponding positions. The second link second end 90 is pivotally coupled to the trolley body coupling extension 108. Thus, the second link second end 90 also moves between a plurality of positions relative to the cam 104. As noted above, the position of the second link second end 90 affects the spacing of the first and second jaw elements 50, 64.

That is, when the handle members 14, 70 are in the first position and cam first flat 118A, with the minimum radius, engages the trolley cam follower 110, the trolley 102 is disposed as close to the first handle member distal end 36 as possible and the jaw elements 50, 64 are as far apart as possible. The user may utilize the cam handle 114 to rotate the cam 104 so that a different flat 118B, 118C, 118D engages the trolley cam follower 110. When a flat 118B, 118C, 118D with a greater radius than the first flat 118A engages the trolley cam follower 110, the jaw elements 50, 64 will be disposed closer together.

It is noted that, unlike the prior art screw-like adjusting device, the cam assembly 100 may be used to quickly change the position of the trolley 102 relative to the first handle member distal end 36 and a one-handed adjustment is possible. That is, because the cam assembly 100 includes the cam handle 114, the movement of the cam 104 between positions is easily accomplished. Further, the rounded transitions 120 between the flats 118A, 118B, 118C, 118D ensures that cam 104 does not catch upon the trolley cam follower 110.

Figure 8:
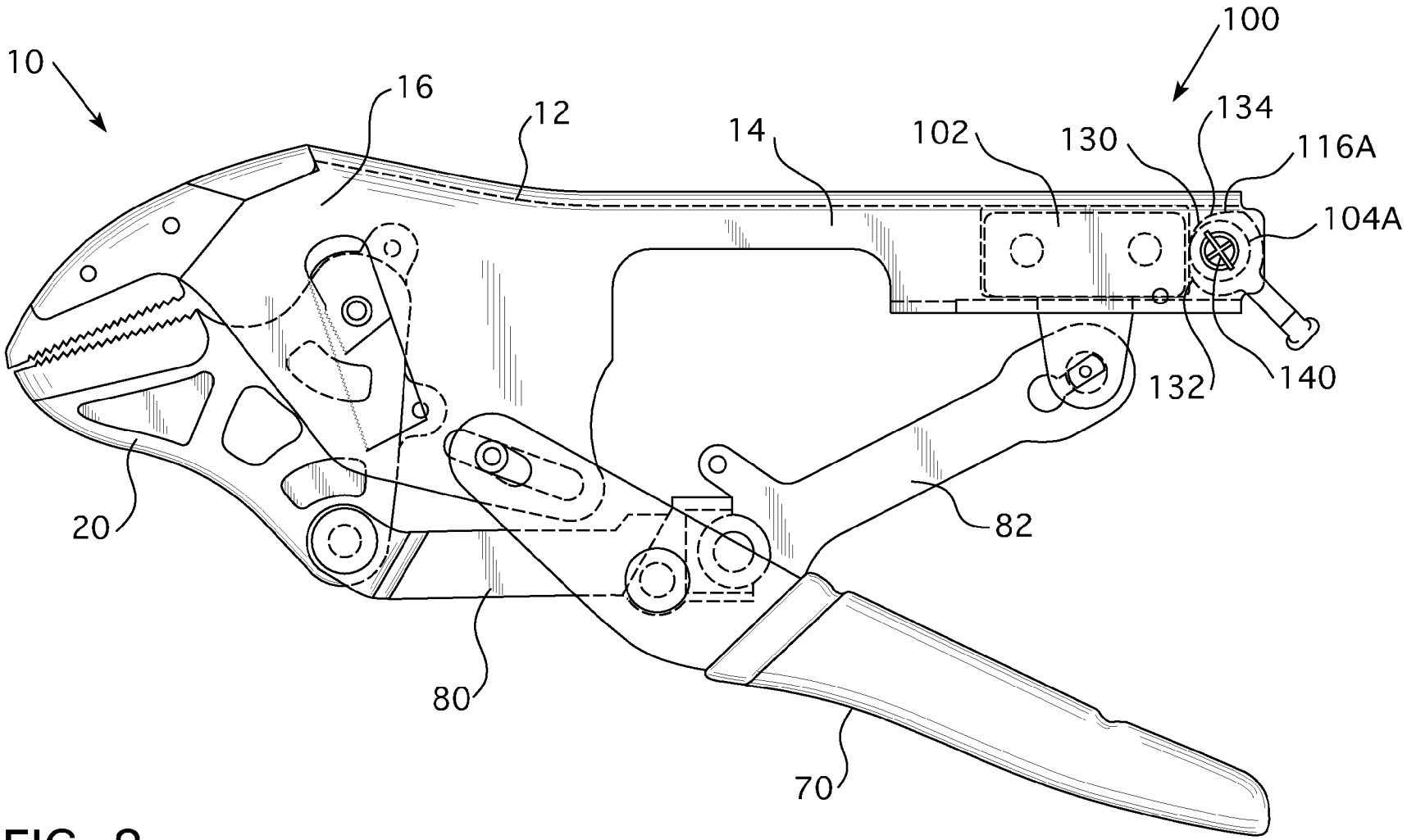
FIG. 8 is a side view of an alternate embodiment wherein the cam has a gradually increasing radius.

In an alternate embodiment, shown in FIG. 8, the cam 104A has a generally smooth radial surface 116A having an arcuate portion 130 wherein the radius changes between a minimum radius 132 at one location to a maximum radius 134 at another location. Preferably, the arcuate portion 130 extends over about 75 and 105 degrees, and more preferably about ninety degrees. Preferably, the cam 104A has a minimum radius 132 of between about 0.18 and 0.22 inch and more preferably about 0.20 inch, and, a maximum radius 134 of between about 0.24 and 0.28 inch and more preferably about 0.26 inch. Preferably, the arcuate portion 130 radius changes at a generally constant rate.

The cam 104A in this embodiment is coupled to the first assembly first handle member distal end 36 and engages the trolley cam follower 110 as described above. The cam 104A may be coupled to the first assembly first handle member distal end 36 with a frictional mounting 140 structured to resist rotational motion of the cam 104A. That is, the frictional mounting 140 is structured to resist the cam 104A from rotating freely even when the jaw elements 50, 64 are in the open position. The friction created by the frictional mounting 140 may be overcome by applying force to the cam handle 114. Thus, the frictional mounting 140 allows the user to place, and keep, the cam 104A in a selected position until the user reorients the cam 104A. The cam 104A with a variable radius provides, essentially, infinite variations to the spacing of the jaw elements 50, 64 in the open position.

While illustrative embodiments of the invention are disclosed herein, it will be appreciated that numerous modifications and other embodiments may be devised by those skilled in the art. Therefore, it will be understood that the appended claims are intended to cover all such modifications and embodiments that come within the spirit and scope of the present invention.

What is claimed is:

1. A cam assembly for adjusting a pair of locking pliers, said locking pliers having a first assembly having an elongated first handle member and a first jaw member, a second jaw member, an elongated second handle assembly, and a link assembly having at least one link, said second jaw member pivotally coupled to said first jaw member so that the jaw members may move between an open position and a closed position, said second handle assembly pivotally coupled to said second jaw member, said at least one link coupled to said first handle member and said second jaw member, wherein the proximity of said at least one link to the distal end of said first handle member affects the spacing of said jaw members, said cam assembly comprising:

a trolley structured to be slidably coupled to said first handle member, said trolley having a cam follower and structured to be coupled to said at least one link;

a cam having a disk-like body with a radially extending handle;

said cam rotatably coupled to said first assembly first handle member and structured to engage said trolley cam follower;

wherein, when in said jaw members are in said open position and when said at least one link is coupled to said trolley, rotation of said cam causes the position of said jaw members to change;

wherein said cam has a radial surface with a plurality of flats, each flat disposed at a different radial distance from the axis of said cam body;

wherein the radii of the flats increases/decreases in series;

said plurality of flats includes a first flat, a second flat, a third flat, and a fourth flat;

said first flat having a radius of between about 0.18 and 0.22 inch; and wherein each successive flat has a radius that is about 0.02 inches further from the axis than the prior flat.

2. The cam assembly of claim 1 wherein said first handle member has a proximal end, a distal end, and defines a channel and wherein:

said trolley is structured to be slidably disposed in said first handle member channel; and said cam is coupled to said first handle member distal end with said radial surface partially disposed in said first handle member channel and said cam body axis extending generally perpendicular to the longitudinal axis of said first handle member.

3. Locking pliers comprising:

a first assembly having an elongated first handle member and a first jaw member;

a second jaw member;

an elongated second handle assembly;

a link assembly having at least one link;

wherein said second jaw member is pivotally coupled to said first jaw member so that the jaw members may move between an open position and a closed position;

said second handle assembly pivotally coupled to said second jaw member;

said at least one link coupled to said first handle member and said second jaw member;

wherein the proximity of said at least one link to the distal end of said first handle member affects the spacing of said jaw members in said open position;

a cam assembly including a trolley and a cam;

said trolley structured to be slidably coupled to said first handle member, said trolley having a cam follower and structured to be coupled to said at least one link;

said cam having a disk-like body with a radially extending handle;

said cam rotatably coupled to said first assembly first handle member and structured to engage said trolley cam follower; and wherein, when in said jaw members are in said open position and when said at least one link is coupled to said trolley, rotation of said cam causes the position of said jaw members to change.

wherein said cam has a radial surface with a plurality of flats, each flat disposed at a different radial distance from the axis of said cam body;

wherein the radii of the flats increases/decreases in series;

said plurality of flats includes a first flat, a second flat, a third flat, and a fourth flat;

said first flat having a radius of between about 0.18 and 0.22 inch; and wherein each successive flat has a radius that is about 0.02 inches further from the axis than the prior flat.

4. The locking pliers of claim 3 wherein said first handle member has a proximal end, a distal end, and defines a channel and wherein:

said trolley is structured to be slidably disposed in said first handle member channel; and said cam is coupled to said first handle member distal end with said radial surface partially disposed in said first handle member channel and said cam body axis extending generally perpendicular to the longitudinal axis of said first handle member.

* * * * *

UNITED STATES PATENT AND TRADEMARK OFFICE

CERTIFICATE OF CORRECTION

PATENT NO. : 7,762,162 B2
APPLICATION NO. : 12/116333
DATED : July 27, 2010
INVENTOR(S) : Charles M. Phillips, Sr. et al.

It is certified that error appears in the above-identified patent and that said Letters Patent is hereby corrected as shown below:

Title page, Item [57] second column, ABSTRACT, line 13, "its' axis" should read --its axis--.
Column 1, line 8, "locking Pliers with CAM" should read --Locking Pliers with CAM--.
Column 2, line 18, "over toggle" should read --over the toggle--.
Column 2, line 18, "become locked" should read --becomes locked--.
Column 3, line 22, "users fingers" should read --user's fingers--.
Column 3, line 57, "detail cross-sectional" should read --detailed cross-sectional--.
Column 4, line 33, "the a first" should read --a first--.
Column 7, line 59, "when in said" should read --when said--.
Column 8, line 42, "when in said" should read --when said--.

Signed and Sealed this

Thirtieth Day of November, 2010

David J. Kappos

David J. Kappos
*Director of the United States Patent and Trademark Office*